US005709458A

United States Patent [19]

Metz

[11] Patent Number: 5,709,458

[45] Date of Patent: Jan. 20, 1998

[54] DOCK LIGHT

[76] Inventor: Donald Metz, c/o N.Y. Dock & Door, Inc. 6311 Fly Rd., Suite A, East Syracuse, N.Y. 13057

[21] Appl. No.: 696,605

[22] Filed: Aug. 14, 1996

[51] Int. Cl.[6] ..... F21V 29/00; F21V 21/32

[52] U.S. Cl. ..... 362/96; 362/294; 362/432; 362/370; 362/419; 362/373; 362/61

[58] Field of Search ..... 362/80, 83.3, 66, 362/147, 198, 199, 253, 287, 294, 370, 371, 373, 418, 419, 432, 390, 369, 96

[56] References Cited

U.S. PATENT DOCUMENTS

| | | | |
|---|---|---|---|
| 1,606,219 | 11/1926 | Havens | 362/418 |
| 2,538,655 | 1/1951 | Preston | 362/419 |
| 3,707,624 | 12/1972 | Marsh | 362/430 |
| 4,109,144 | 8/1978 | Vidmar | 362/294 |
| 4,882,467 | 11/1989 | Dimick | 362/140 |
| 4,973,016 | 11/1990 | Hertenstein | 362/432 |
| 5,129,928 | 7/1992 | Chan et al. | 55/97 |
| 5,357,414 | 10/1994 | Dane et al. | 362/432 |

*Primary Examiner*—Thomas M. Sember

*Attorney, Agent, or Firm*—Sughrue, Mion, Zinn, Macpeak & Seas, PLLC

[57] ABSTRACT

A dock light assembly includes a base member adapted to be secured inside a warehouse adjacent a door opening at a loading dock, a hollow flexible self-supporting tube connected at one end thereof to the base member and a lamp assembly mounted at an opposite end of said tube for lighting the interior of a cargo vehicle located adjacent said door of said loading dock. A fan assembly is provided in the base member for blowing air through the base member, hollow flexible tube and the lamp assembly to cool the lamp assembly. A thermal fuse may be provided in the circuit of the lamp assembly to turn off the lamp assembly should overheating of the lamp assembly occur.

6 Claims, 3 Drawing Sheets

DOCK LIGHT

BACKGROUND OF THE INVENTION

The present invention is directed to a dock light and more specifically to a light which is adapted to be mounted inside a warehouse adjacent a door on the loading platform which is adapted to extend in an adjustable manner outwardly of the warehouse to shine into the interior of a truck backed up to the loading platform. The dock light is designed to resist damage to the light due to accidental closure of an overhead door on the dock light and to provide longer life for the bulb with an improved cooling system.

The use of dock lights on the loading platform of a warehouse or the like for the purpose of illuminating the interior of a truck backed up to the loading platform, are old and well known in the art. Typically, the light is mounted adjacent to the loading dock of the warehouse undercover to protect the dock light from the elements when not in use. Such a dock light is provided with some type of extendable linkage for extending the dock light through the door of a truck so that it can shine into the interior of the truck. Frequently, the dock attendants forget to move the dock light from inside the truck before closing the truck door resulting in serious damage to the dock light.

Such an extensible dock light is disclosed in the U.S. patent to Preston (U.S. Pat. No. 2,538,655). In the Preston patent, the dock light is mounted on the ceiling of the loading platform and extends downwardly therefrom. The dock light is provided with an extensible articulated arm so that the light fixture may be manipulated to locate the light bulb inside a truck which is backed up to the loading platform. An arm of the light fixture is provided with a pivotal connection and a latch to hold the light fixture in the desirable position. In order to prevent damage to the light fixture, if the light is inadvertently left inside the truck when the truck pulls away, a latch is provided in conjunction with the pivotal connection to allow the arm to pivot and reduce the possibility of damage to the light fixture.

Due to the advent of high intensity halogen bulbs, it is desirable to cool the lamp bulbs to increase the endurance and usable life time of the light fixture. In order to provide such cooling, an air cooled light is disclosed in the U.S. patent to Collins (U.S. Pat. No. 4,586,117). In the Collins patent, a light fixture is mounted on a base member by means of a hollow tubular support having an intermediate pivotal connection to provide adjustability for the light fixture. The base member is provided with a fan unit for drawing exterior air into the base member and through the tubular support for cooling the light bulb. A battery is also provided in the base for providing power for the fan and the light bulb. The U.S. patent to Williams (U.S. Pat. No. 4,039,817) also discloses a cooling system for a high intensity lamp used in a microscope.

It is also known to mount a light bulb and reflector assembly to a base member by means of a flexible stem having a resilient helical structure which enables the stem to be manipulated so as to locate the lamp in any desired position relative to the base member. Such a lamp is disclosed in the U.S. patent to Merlo (U.S. Pat. No. 4,238,816).

SUMMARY OF THE INVENTION

The present invention is directed to a new and improved dock light wherein the lamp assembly is mounted on a hollow flexible tube, which in turn is connected to a base member adapted to be secured to a rigid support structure. The hollow flexible tube is self supporting whereby the lamp assembly may be angled in any desired direction relative to the base member and the base member may be provided with a fan for providing a flow of cooling air through the hollow flexible tube to cool the light bulb associated with the lamp assembly. A thermostatic device may be provided in the lamp assembly to shut off power to the lamp assembly in the event of overheating due to a failure of the fan or the blockage of the hollow flexible tube.

The above and other objects, features and advantages of the present invention will be more apparent and more readily appreciated from the following detailed description of preferred exemplary embodiment of the present invention, taken in connection with the accompanying drawings.

DETAILED DESCRIPTION OF THE INVENTION

Figure 1:
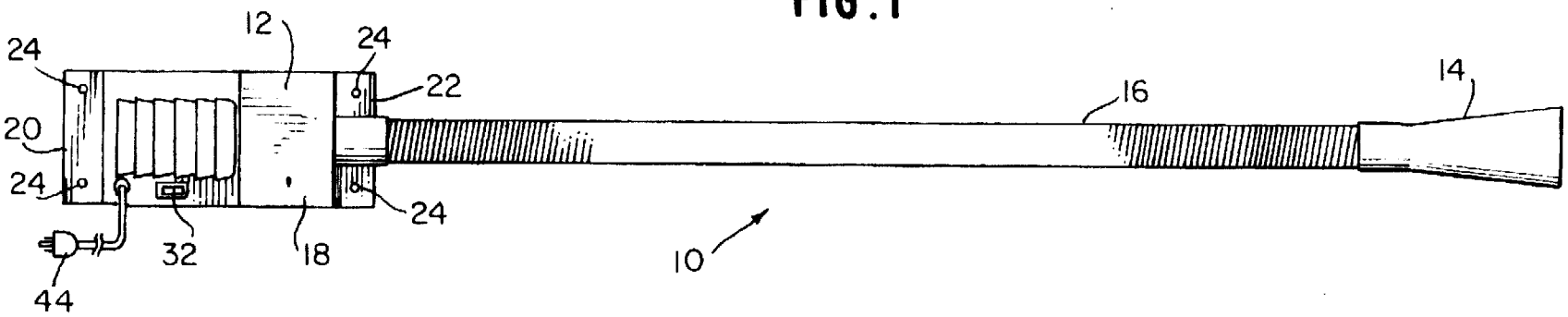
FIG. 1 is a top plan view of a dock light according to the present invention.
Figure 2:
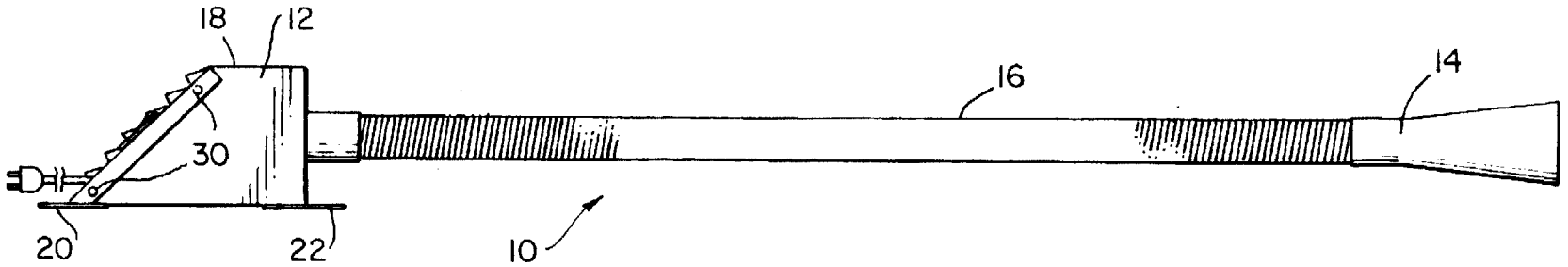
FIG. 2 is a side elevational view of the dock light shown in FIG. 1.
Figure 3:
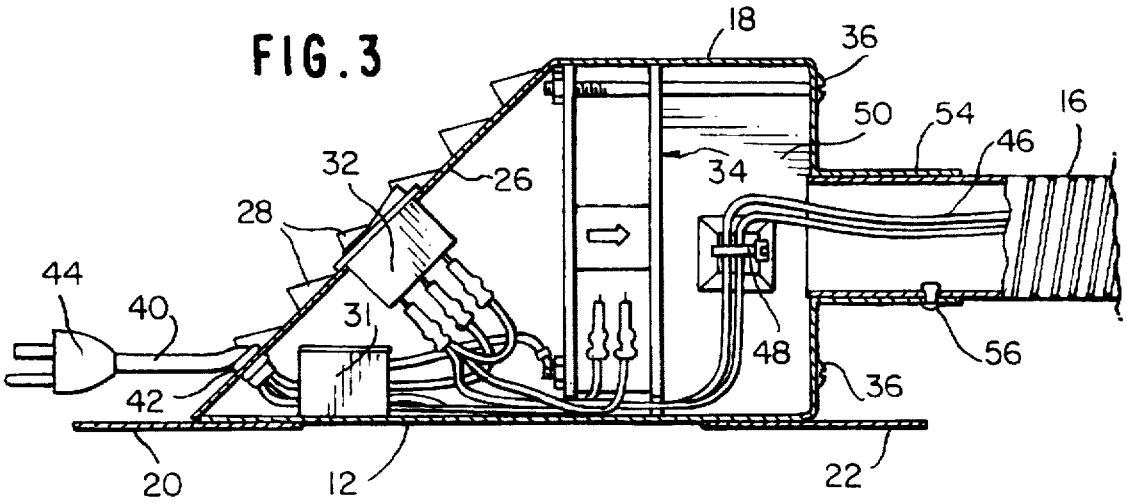
FIG. 3 is a partially broken away side elevational view of the base of the dock light assembly.

The dock light 10 according to the present invention is comprised of a base member 12 and a lamp assembly 14 connected to each other by a hollow flexible self-supporting tube 16. The base member 12 includes a housing 18 having a pair of attachment brackets 20 and 22 having screw holes 24 therethrough for the reception of screws to secure the base member to a solid supporting structure such as a wall, door frame or a ceiling adjacent a door on a loading platform. The exact location of the base member depends on the structural situation available.

The housing 18 is provided with a cover plate 26 having a plurality of ventilation openings therethrough covered by louvers 28 to allow the flow of air through the interior of the housing 18. The cover 26 is detachably secured to the housing 18 by means of screws 30 so that access may be obtained to the interior of the housing for servicing purposes. The cover 26 has a toggle switch 32 mounted thereon for controlling the flow of electricity to a fan assembly 34 mounted in the housing by means of bolts 36.

Figure 4:
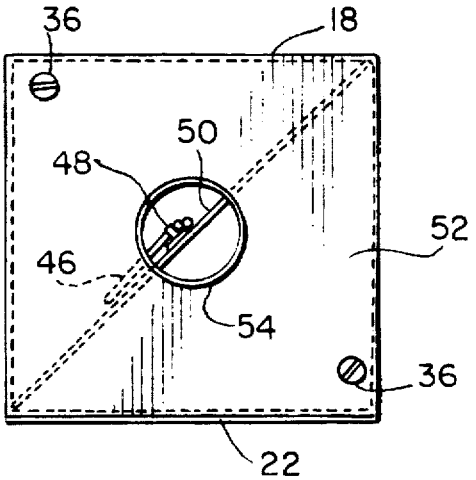
FIG. 4 is an end elevational view of an air interrupter mounted on the base member.

An electrical supply wire 40 extends through a fitting 42 secured to the cover 26 and is provided at the opposite end with a plug 44 for connection to a source of electrical power. The wire 40 is connected within the housing 18 to a transformer 31, the switch 32, the fan assembly 34 and to wires 46 which extend outwardly through the hollow flexible tube 16 to supply electrical power to the lamp assembly 14. The wires 46 leading to the lamp assembly are supported by means of a clamp 48 on an air flow deflector plate 50 which extends diagonally across the housing 18 as best seen in FIG. 4. The end wall 52 of the housing 18 is provided with a hollow tubular sleeve 54 integral therewith into which the hollow tubular support 16 extends and is secured by means of rivets 56. The deflector plate 50 extends diametrically across the opening formed by the sleeve 54 so as to interrupt the flow of air from the fan assembly 34 to prevent the formation of a vortex within the housing 18 which would interfere with the flow of air through the support 16.

Figure 5:
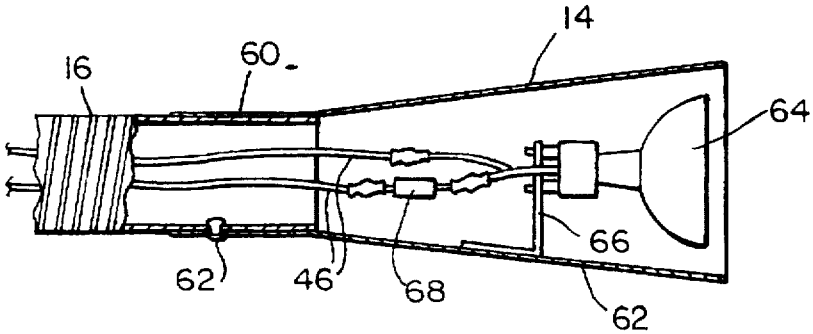
FIG. 5 is a sectional side elevational view of the lamp assembly.

The lamp assembly 14 as shown in FIG. 5, is comprised of a hollow tubular socket member 60 into which the opposite end of the hollow tubular support 16 extends and which is secured therein by means of rivets 61. An outwardly tapered reflector 62 is integral with the hollow tubular socket 60 and a low voltage, high output halogen lamp 64 is mounted within the reflector 62 by means of an L-shaped bracket 66. The lead wires 46 extending from the base member through the support 16 are connected to the lamp assembly. A thermal fuse 68 is mounted in one lead to the lamp 64 which will interrupt the flow of power to the lamp should the heat within the reflector 62 reach an undesirably high level which could lead to damage of the halogen lamp.

Figure 6:
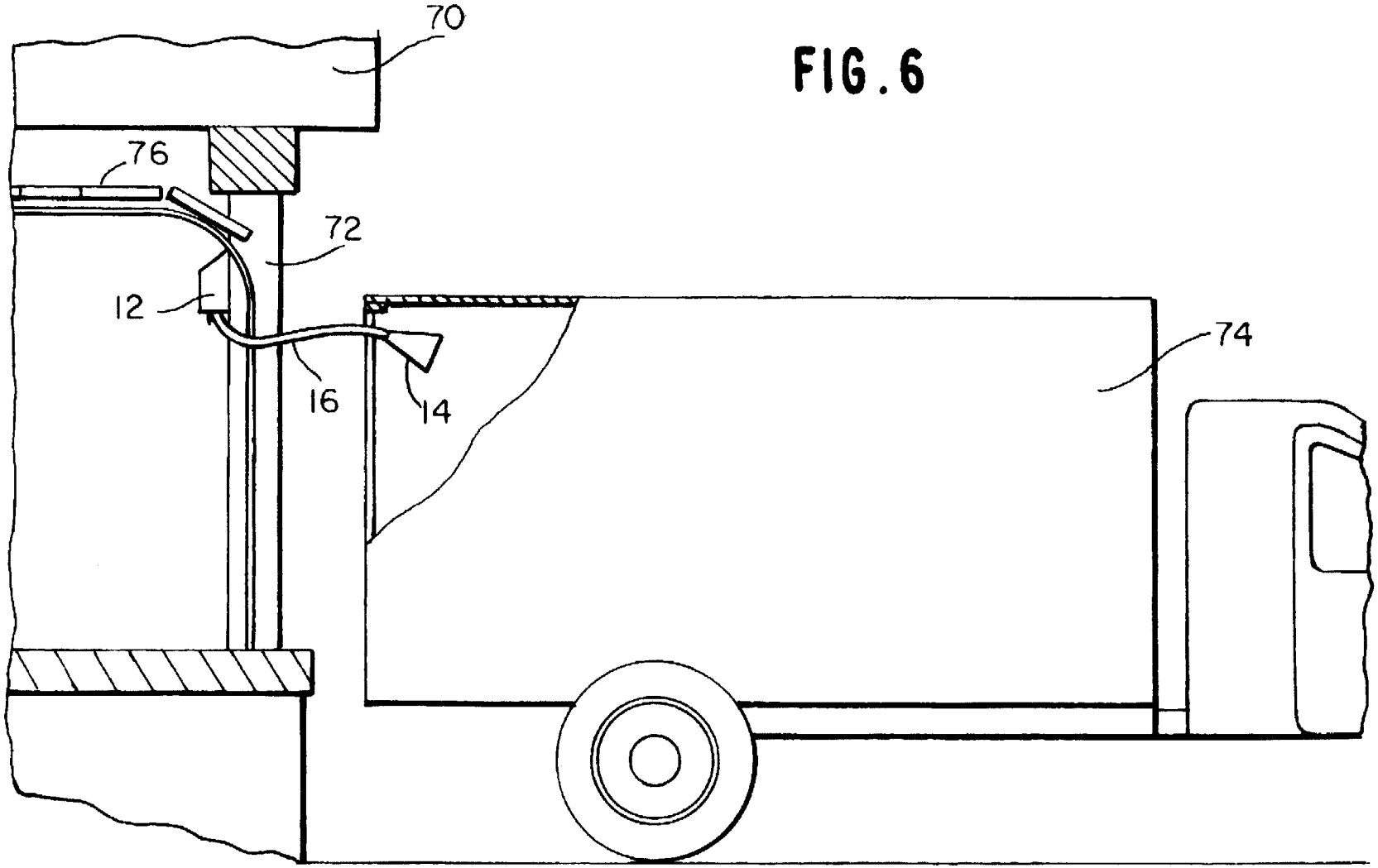
FIG. 6 is a side elevational view, partly in section, of a loading dock and truck with the dock light of the present invention.

To use the dock light, the base member 12 may be mounted on a door frame 72 within a warehouse 70 as shown in FIG. 6. The base member 12 is mounted so that the flexible self-supporting tube 16 can be bent to extend outwardly through the door to place the lamp assembly 14 in close proximity to or inside the open rear end of a truck 74 backed up to the loading platform.

The plug 44 is then connected to a suitable source of electric power and upon operation of the off-on toggle switch 32, the halogen lamp 64 will be turned on and the fan assembly 34 will also be turned on to draw a cooling supply of air inwardly through the louvered openings 28, through the interior of the housing 18 and through the hollow tubular support 16 and ultimately flow over the halogen lamp 64 to cool the lamp. As pointed out above, should the temperature within the lamp assembly 14 become excessive due to failure of the fan or an obstruction of the air flow, the thermal fuse 68 will cut off power to the lamp 64. During normal operation, upon completion of the loading or unloading of the truck, the lamp assembly 14 will be returned to the inside of the building by flexing the hollow tubular support 16. If the lamp assembly 14 is inadvertently left in the extended position outside the door opening and an overhead door 76 is closed, the overhead door 76 will merely engage the hollow tubular support 16 and bend the same to automatically deflect the lamp assembly 14 inside the building without causing any damage to the lamp assembly.

The flexible, hollow, self-supporting tube 16 may be of any desired construction which will resist impact of a door or any other object but which will allow the lamp assembly to be supported in any desired position. As shown, the self-supporting tubular support 16 is comprised of a spiral metallic assembly interfitted to provide a self-supporting flexible member.

While the invention has been particularly shown and described with reference to preferred embodiments thereof, it will be understood by those in the art that the foregoing and other changes in form and details may be made therein without departing from the spirit and scope of the invention.

What is claimed is:

1. A loading dock and light assembly comprising door means on said loading dock for providing communication between a warehouse interior and an interior of a cargo vehicle disposed adjacent said loading dock, a dock light comprising a base member, a hollow flexible self-supporting tube connected at one end thereof to said base member and a lamp assembly connected to an opposite end of said tube, said base member having air flow means for providing a flow of air through said base member and through said tube to said lamp assembly, said base member being mounted in said warehouse adjacent said door means whereby said tube can be manipulated outwardly through said door means to locate said lamp means in a position for illuminating said interior of said cargo vehicle.

2. A loading dock and light assembly as set forth in claim 1, wherein said air flow means includes a housing having louver means to permit entry of air into said housing, a fan mounted in said housing and deflector means disposed between said fan and said tube for directing air from said fan into said tube.

3. A loading dock and light assembly as set forth in claim 2, further comprising circuit means for supplying electric power to said fan and said lamp assembly and including switch means for controlling a flow of current to said fan and said switch means.

4. A loading dock and light assembly as set forth in claim 3, wherein said circuit means includes a transformer located in said base member and a low voltage, high output halogen lamp mounted in said lamp assembly.

5. A loading dock and light assembly as set forth in claim 3, further comprising thermal fuse means in said circuit means in said lamp assembly for interrupting the flow of current to said lamp assembly upon overheating of said lamp assembly.

6. A dock light for use at a loading dock to illuminate an interior of a cargo vehicle located adjacent the loading dock, said dock light assembly comprising a base member adapted to be mounted adjacent a door of the loading dock inside a building structure, a hollow flexible self-supporting tube connected to said base member at one end of said tube and a lamp assembly connected to an opposite end of said tube, said base member having air flow means for providing a flow of cooling air through said base member and through said tube to said lamp assembly for cooling said lamp assembly, wherein circuit means are provided for supplying electric power to said air flow means and said lamp assembly and including switch means for controlling flow of current to said air flow means and said lamp assembly, said circuit means including a transformer located in said base member and a low voltage, high output halogen lamp mounted in said lamp assembly.

* * * * *